US005823456A

United States Patent [19]

Bordignon et al.

[11] Patent Number: 5,823,456

[45] **Date of Patent: *Oct. 20, 1998**

[54] COILING ASSEMBLY FOR IRON AND STEEL PRODUCTS

[75] Inventors: Giuseppe Bordignon, Bicinicco; Ferruccio Tomat, Udine, both of Italy; Kurt Lennart Danielsson, Smedjebacken, Sweden; Giorgio Lavaroni, Buttrio, Italy

[73] Assignee: Danieli & C. Officine Meccaniche SpA, Buttrio, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 536,144

[22] Filed: Sep. 29, 1995

[30] Foreign Application Priority Data

Sep. 30, 1994 [IT] Italy ..... UD94A0157
May 19, 1995 [IT] Italy ..... UD95A0091

[51] Int. Cl.[6] ..... B21C 47/02; B21C 47/14; B21F 3/00

[52] U.S. Cl. ..... 242/362; 242/361.2; 242/361.4; 140/124

[58] Field of Search ..... 242/362, 361.2, 242/361.3, 361.4; 140/124, 71 C

[56] References Cited

U.S. PATENT DOCUMENTS 3,395,560 8/1968 Cofer et al. ..... 242/362 X
4,747,557 5/1988 FuJimaki ..... 242/362

FOREIGN PATENT DOCUMENTS 74760 9/1982 European Pat. Off. .
582385 7/1933 Germany .
1499142 12/1966 Germany .
2223709 5/1972 Germany .
2048327 12/1980 United Kingdom .

*Primary Examiner*—John Q. Nguyen
*Attorney, Agent, or Firm*—Antonelli, Terry, Stout & Kruas, LLP

[57] ABSTRACT

Coiling assembly for iron and steel products, which cooperates with an element (16) to feed the rolled product and includes a stacking element (11) associated with a coaxial cylindrical drum (13) so as to define an annular channel (14) to contain, form and accumulate spirals (15), an annular plate (17) being included to support the spirals (15) being formed and having a first high position **(17*a*) for the start of coiling in cooperation substantially with the element (16) feeding the rolled product, a plurality of intermediate positions defined along the annular channel (14) and a position (17*b*) for the end of coiling in cooperation with the bottom (18) of the annular channel (14), circumferential means (19*a*, 19*b*) to contain spirals (15) being included in cooperation at least with the upper part of the annular channel (14) and in cooperation at least with one of the sidewalls (20, 21) thereof (14) and extending radially within the annular channel (14) at least along a determined initial segment thereof (14)**.

13 Claims, 4 Drawing Sheets

COILING ASSEMBLY FOR IRON AND STEEL PRODUCTS

BACKGROUND OF THE INVENTION

This invention concerns a coiling assembly for iron and steel products.

To be more exact, the coiling assembly according to the invention is applied in a rolling plant to the coil-forming station positioned downstream of the rolling train.

The invention is used advantageously, but not only, in connection with iron and steel products such as wire, wire rod or rod having a diameter between 8 and 50 mm. and with a very high speed of feed thereof.

This invention enables the method of distributing the spirals in a stacking assembly to be perfected.

The rolled products leaving the finishing train in conventional rolling plants normally undergo a preliminary cooling before being sent to the coiling station, in which there is a spiral-forming assembly which generally, but not only, has a substantially vertical axis.

The spiral-forming assembly is formed as a cylindrical tubular element comprising an inner stacking element and an outer jacket to define an annular channel to contain, form and accumulate the spirals.

The spiral-forming assembly is rotated about its own axis in the spiral-forming step and cooperates with a unit which feeds the rolled product to be coiled and which consists of a pre-curving means, an introducing tube or another analogous means.

It is known that the formation of a coil may lead to damage to the spirals inasmuch as the spirals scrape against the containing sidewalls of the cylindrical tubular element both during the step of descent within the annular channel and in the step of re-ascent during the raising of the plate and discharge of the coil.

This causes problems of abrasion of the sidewalls of the annular channel containing the spirals and also damage to the rolled material.

SUMMARY OF THE INVENTION

The present applicants have designed and embodied this invention to overcome these shortcomings, and to obtain a coiling assembly able to improve the degree of compaction of the coil and to increase its yield and also to solve the problems of the scraping and damage of the material during coiling.

The purpose of the invention is to embody an assembly to coil iron and steel products which is suitable to achieve a high coefficient of filling and therefore to obtain a compact, dense and stable coil.

The invention is applied advantageously, even if not only, to iron and steel products such as wire, wire rod or rod having a diameter between 8 and 50 mm. and fed at a high speed.

A further purpose of the invention is to reduce and even to eliminate the possibility of scraping of the descending spirals against the sidewalls of the annular containing channel.

The coiling assembly according to the invention includes a stacking element with a coiling axis generally, even if not only, vertical or almost vertical, the stacking element being associated with an outer cylindrical shell and cooperating with an annular base plate.

This coiling assembly cooperates with an assembly which feeds the product to be coiled and which consists of an introducing tube, a pre-curving means or an analogous feeding means.

According to one embodiment of the invention the feeding element during working is caused to oscillate from the outer diameter to the inner diameter of the annular channel in a manner advantageously synchronised with the variable speed of rotation of the coil-forming assembly for the purpose of distributing correctly and in an orderly manner the spirals over the whole surface of the annular plate.

The feeding element can be of a type which can be elongated telescopically or of a stationary type.

In the coiling assembly, at each start-up of the cycle the annular base plate is positioned in a first raised position in direct cooperation with the element feeding the product to be coiled.

While the spirals are being formed to constitute a layer on the annular plate, the plate itself is lowered progressively at a speed correlated functionally with the speed of feed of the product and with the diameter thereof.

The movement of descent is actuated in a controlled manner at each formation of a layer; the lowering advantageously corresponds substantially to the nominal diameter of the product to be coiled; this has the effect that the distance between the surface on which the coils are deposited and the product-feeding element remains substantially constant with a very small value during the coiling cycle.

This situation leads to the obtaining of a more compact and dense coil, at the same time improving the coefficient of filling and therefore the yield of the assembly and producing a finished product, namely a coil, of a better quality.

According to other embodiments of the invention the movement of descent is continuous and is correlated with the diameter of the product during the coiling step.

When the coiling cycle has been completed, the annular plate reaches its fully lowered position, whence it is then raised for the expulsion and discharge of the coil.

According to the invention the alternating movement of the annular plate is obtained by means of a plurality of chains working with a synchronised actuation.

According to a variant the chains are connected to each other mechanically by a transmission and are driven by a motor.

According to another variant a motor reducer unit is included on the machine to obtain a slow descent of the annular plate during the coiling and a motor reducer unit is positioned outside the machine for the speedy raising of the plate during the step of expulsion of the formed coil.

According to another variant the chains are of a type which can be bent in only one direction.

According to yet a further variant the chains are driven by respective motors connected together electrically.

The chains run within stationary guides positioned at the sides of the annular containing channel and have one of their ends firmly secured to the annular plate; the guides within which the chains run are advantageously of a replaceable type.

According to the invention the chains are of a type which can operate by drawing or by thrusting so as to obtain the alternating movement of the annular plate.

The means which drive the chains comprise at least one pinion associated with a drive shaft.

According to a variant the chains cooperate with a transmission.

According to the invention circumferential containing means are included substantially in cooperation with the upper part of the coiling assembly and with the circumferential sidewalls which define the annular channel containing the spirals.

These circumferential containing means extend in a substantially radial direction in relation to one of the two sidewalls of the annular channel and at least for an upper initial determined segment of the annular channel and partly towards the inside of the channel, thus restricting the space usable for formation of the spirals.

According to another embodiment circumferential containing means are included on both the sidewalls of the annular channel.

These circumferential containing means may consist of independent means and may cooperate with the conformation of the first upper segment of the sidewalls defining the annular channel containing the spirals.

The coil being progressively formed thus has the respective innermost and outermost spirals separated from the sidewalls of the annular channel containing the spirals.

During the step of expulsion of the annular plate when the coil has been completed, the circumferential containing means are displaced further apart to enable the annular containing channel to be opened and the coil to be discharged.

According to one embodiment of the invention this opening is obtained automatically in the first segment of the discharge travel of the annular plate.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
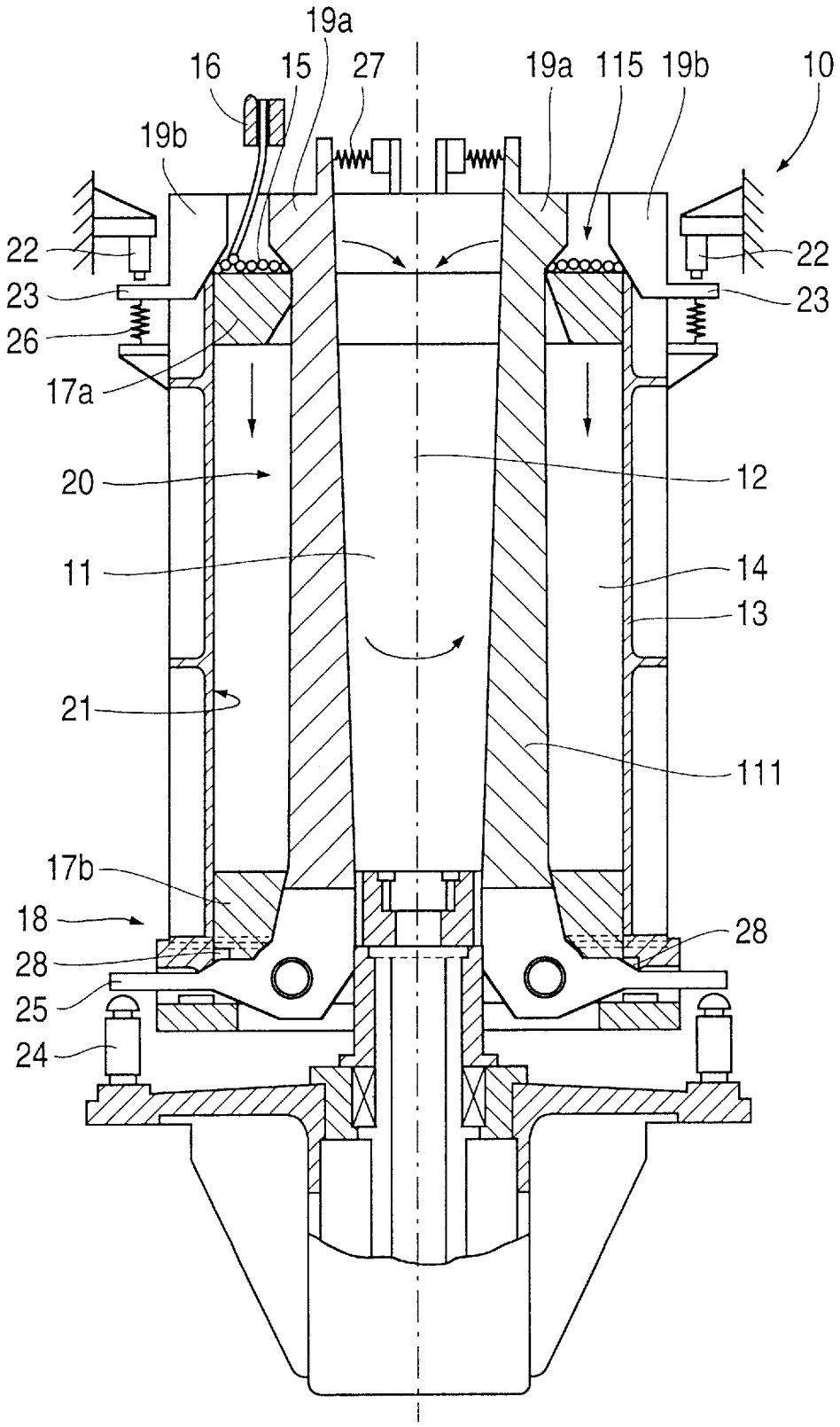
FIG. 1 shows a longitudinal section of a preferred form of embodiment of the coiling assembly according to the invention.

A coiling assembly 10 shown in the figures includes an inner stacking element 11 or coil-forming element, which has a diameter "d1" and a vertical coiling axis 12 and cooperates with an outer cylindrical drum 13 having a diameter "d2" so as to define an annular channel 14 for the containing, forming and progressive accumulation of spirals 15.

The coiling assembly 10 cooperates with a feeding element 16 feeding the rolled product and consisting of an introducing tube, a pre-curving means or another element having the same purpose.

Figure 8:
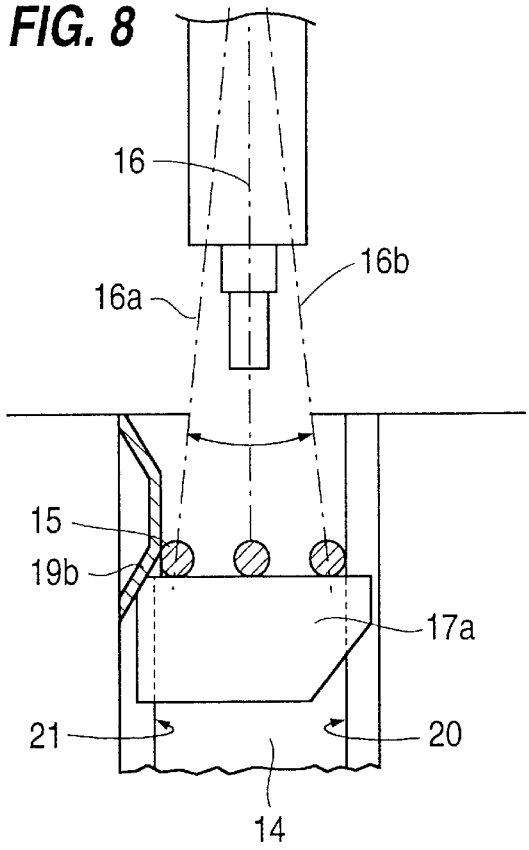
FIG. 8 shows diagrammatically the steps of displacement of the element that feeds the product to the coiling assembly.

According to the invention (see FIG. 8) the feeding element 16 oscillates during its working between two limit positions 16*a* and 16*b* for cooperation alternately with an outer sidewall 21 and inner sidewall 20 respectively defining the annular channel 14, thus enabling a more correct and orderly arrangement of the spirals 15 to be achieved on the whole surface of an annular supporting plate 17.

The speed of oscillation of the feeding element 16 is correlated with the speed at which the coiling assembly 10 rotates.

Moreover, the feeding element 16 may have an unchangeable length or be able to be elongated telescopically.

The coiling assembly 10 rotates about a rotation axis 12 and forms the spirals 15 progressively.

Figure 2:
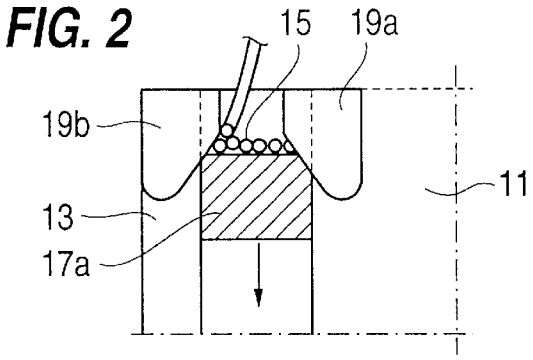

According to the invention at the beginning of the cycle the annular plate 17, which supports the coil being formed, is located in a fully raised position in direct cooperation with the feeding element 16 (position 17*a*, FIG. 2).

When the formation of a first layer 115 of spirals 15 has been completed, the annular plate 17 is lowered with a controlled movement to enable a new layer to be formed.

The value of that lowering advantageously corresponds substantially to the thickness of the rolled product, so that the distance between the feeding element 16 and the last formed layer 115 of spirals 15 remains substantially constant.

This situation obviates the inclusion of a free space for falling of the single spirals 15 into the annular containing channel 14 and leads to the formation of a dense and compact coil and to the improvement of the coefficient of filling of the coiling assembly 10.

Figure 3:
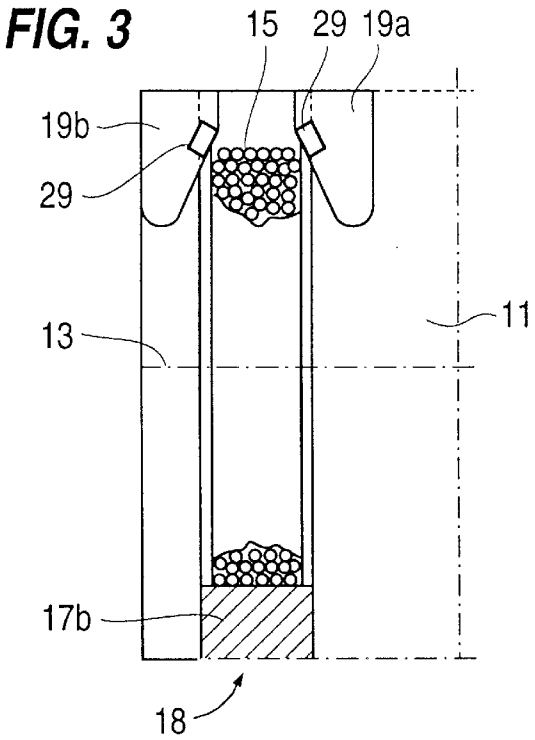
FIGS. 2, 3 and 4 are diagrams of three steps of the coiling cycle and, in particular, the starting step of the cycle, the finishing step of the cycle and the step of expulsion of the coil respectively.

The lowering of the annular plate 17 proceeds progressively downwards until reaching the bottom 18 corresponding to completion of the coil (position 17*b*, FIG. 3).

From this position the annular plate 17 is raised for discharge of the coil.

According to the invention circumferential means 19 to contain and define the space usable for formation of the spirals 15 are included in cooperation with the upper part of the coiling assembly 10.

In particular, circumferential means 19*a* are included in cooperation with the inner sidewall 20 and circumferential means 19*b* are included in cooperation with the outer sidewall 21 of the annular containing channel 14.

In the case shown in FIG. 1 the circumferential means 19*a* cooperate with the conformation of a first upper segment of blades 111 which define the inner sidewall 20 of the annular containing channel 14, whereas the circumferential means 19*b* consist of independent means.

These circumferential means 19*a* and 19*b* are formed as blades or circular sectors, each of which covers a desired angle of the inner and outer circumferences which define the annular containing channel 14.

These circumferential means 19*a* and 19*b* extend at least partly radially into the annular containing channel 14 at least in its first upper segment.

These circumferential means 19*a* and 19*b* have the task of restricting laterally the coil being formed so that the respective innermost and outermost spirals 15 of the coil do not scrape against the sidewalls 20, 21 of the annular containing channel 14 during lowering of the annular plate 17.

This situation prevents possible abrasions and scraping of the sidewalls 20, 21 and of the product being coiled.

Figure 4:
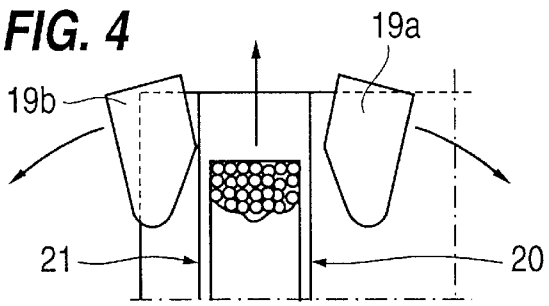
Figure 5:
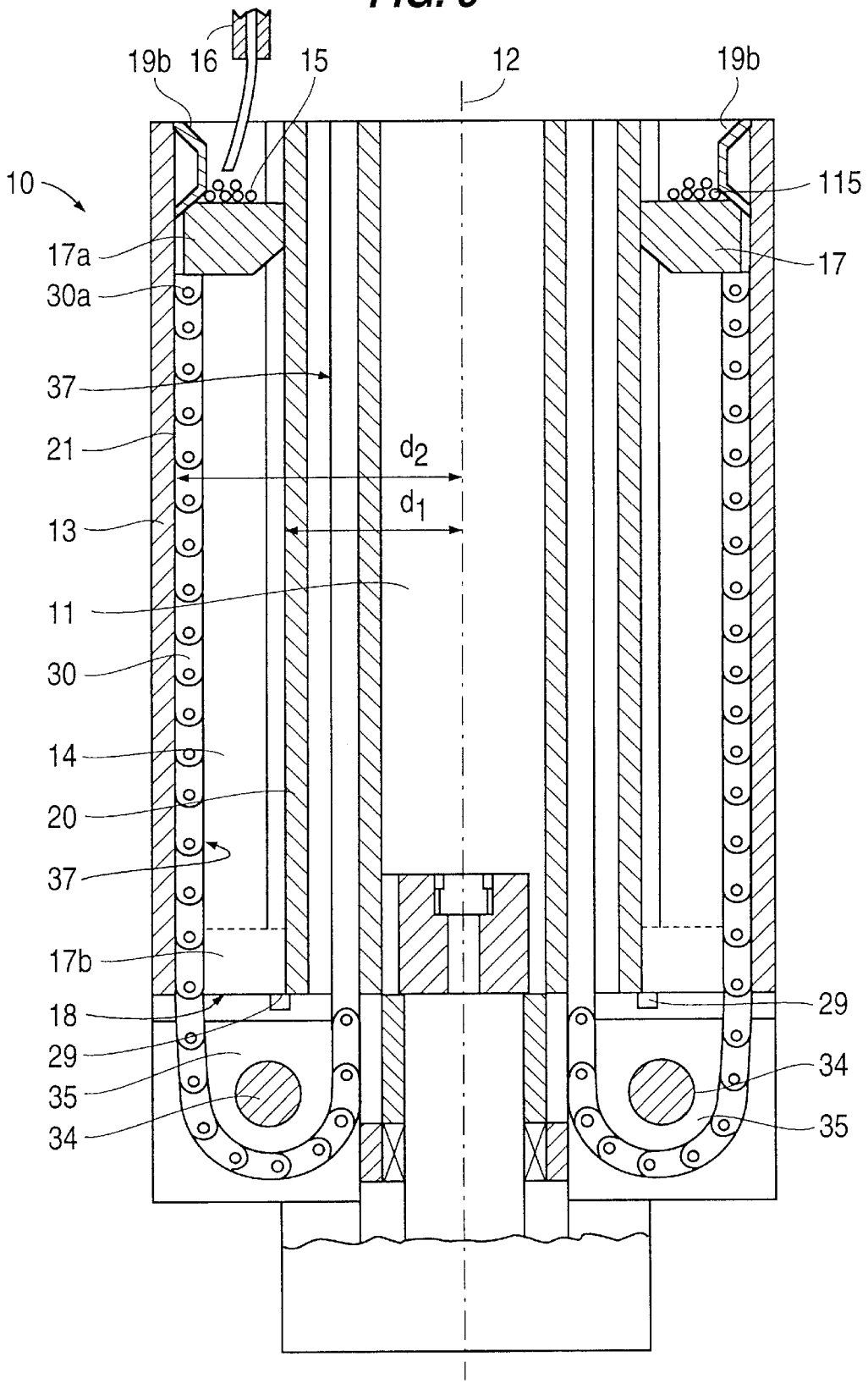
FIG. 5 shows a variant of FIG. 1.

During the step of expulsion of the formed coil the circumferential means 19*a* and 19*b* are moved further apart inasmuch as otherwise they would contact the coil and prevent its discharge (FIG. 4).

The invention includes means to separate further apart the circumferential means 19*a*, 19*b*, the actuation thereof being advantageously governed automatically by the start of the expulsion step.

According to the embodiment shown in FIG. 1 these separation means comprise upper actuators 22, which cooperate with the outer circumferential means 19*b* by means of levers 23 with which the outer circumferential means 19*b* are equipped, and also comprise lower actuators 24 which act on levers 25 provided at the end of the blades 111.

The upper 22 and lower 24 actuators cooperate with resilient travel adapter means 26 and 27 respectively, which not only restrict in a desired and adjustable manner the maximum field of the outward movement of the circumferential means 19*a*, 19*b* but also ensure the return thereof to a starting position.

Sensors 28 are included in this case to govern automatically the actuation of the actuators 22, 24 in the expulsion step and are positioned at the bottom 18 of the coiling assembly 10 and detect the first upward movement of the angular plate 17 during the expulsion step.

In another possible embodiment, sensors 29, shown in FIG. 3, are included and detect contact between the spirals 15 of the upper end of the formed coil and the surface of the circumferential means 19*a*, 19*b* and actuate the actuators 22, 24 for the opening of the circumferential means 19*a*, 19*b*.

In this case the system for vertical alternating movement of the annular plate 17 comprises a plurality of chains 30, four in this specific case, the front end 30*a* of each of which is firmly secured to the annular plate 17.

These four chains 30 are distributed symmetrically about the circumference of the annular plate 17; in this case the chains 30 are connected mechanically together by a transmission 32, which comprises shafts, gears and toothed wheels and is driven by a motor advantageously of a hydraulic or electrical type.

The toothed wheels may be replaced or integrated with universal couplings or other analogous elements for the transmission of motion.

Each chain 30 is associated with a relative pinion 35, which is moved by a drive shaft 34.

Figure 7:
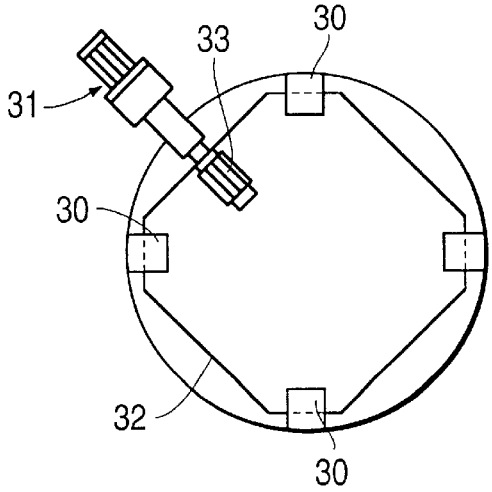
FIG. 7 is a diagram of a possible system for transmission of the motion of the coiling assembly according to the invention.

In the embodiment of FIG. 7 the system for vertical movement of the annular plate 17 includes a first motor reducer unit 33 which is positioned on the machine and has the purpose of carrying out slow lowering of the plate during the coiling step, and also includes a second motor reducer unit 31 positioned outside the machine.

The second motor reducer unit 31 positioned outside the machine is associated with an automatic disengagement system and has the purpose, upon completion of formation of the coil and with the coiling machine halted, of raising the annular plate 17 swiftly for quick expulsion of the completed coil.

The chains 30 run within stationary guides 37 positioned parallel to each other at one side and the other side of the annular channel 14.

Figure 6:
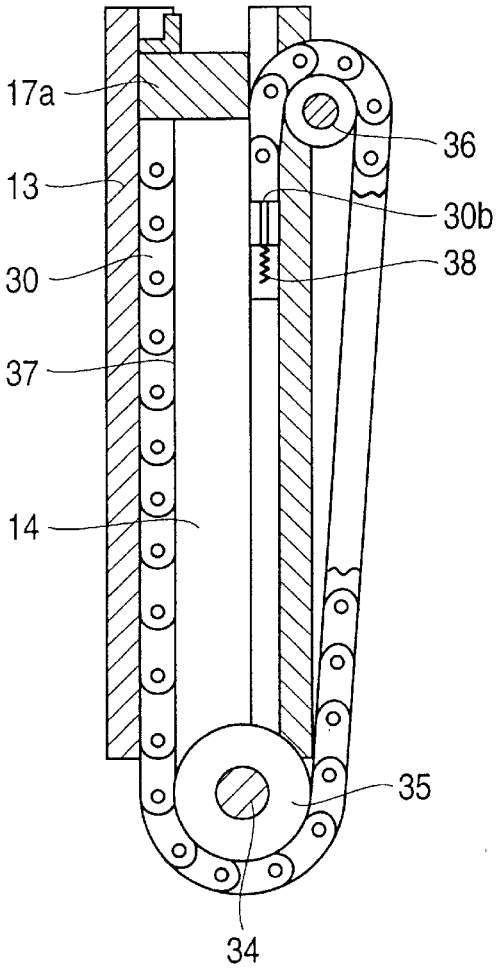
FIG. 6 shows a variant of FIG. 5.

According to the variant shown in FIG. 6 the chains 30 cooperate with a transmission wheel 36 and have their rear end 30*b* secured to a counterweight 38 or another equivalent balancing system.

We claim:

1. Coiling assembly for iron and steel products, which cooperates with a feeding element to feed the product to an upper portion of the coiling assembly, the coiling assembly comprising: a stacking element; a cylindrical drum provided around and coaxial with the stacking element defining therebetween an annular channel to contain spirals of the product; a movably mounted annular plate provided in the annular channel to support the spirals and movable to a first high position for a start of coiling in cooperation substantially with the feeding element feeding the product, a bottom position for an end of coiling in cooperation with a bottom of the annular channel, and a plurality of intermediate positions between the first high position and the bottom position; a vertical adjustment system for lowering the annular plate during formation of the spirals and for raising the annular plate in a step of discharge of the formed coil; and circumferential means provided at an upper part of the annular channel to laterally contain spirals on the annular plate and in cooperation with the sidewalls radially defining the annular channel thereof and extending radially within the annular channel at least along a predetermined initial segment thereof to prevent the spirals from scraping against the sidewalls.

2. Assembly as in claim 1, in which the circumferential means cooperate with an upper conformation of sidewalls of the annular channel.

3. Assembly as in claim 1, in which the feeding element is telescopic type with a variable length.

4. Assembly as in claim 1, in which the circumferential means cooperate with actuator means for outwardly separating the circumferential means during expulsion of the coil.

5. Assembly as in claim 4, in which the actuator means is associated with resilient contrast means for limiting the outward separation of the circumferential means.

6. Assembly as in claim 4, further comprising a sensor for a beginning of the step of discharge of the formed coil, wherein the actuator means is operably connected to and governed by the sensor.

7. Assembly as in claim 1, in which the vertical adjustment means system comprises chains actuated in synchronization and provided within stationary guides positioned at sides of the annular channel.

8. Assembly as in claim 7, in which the chains are connected together mechanically by a transmission associated with a motor.

9. Assembly as in claim 7, in which the chains cooperate with respective motor.

10. Assembly as in claim 9, in which the motors comprise at least one first motor reducer unit operating at a first speed for the slow displacement of the annular plate in descent during the coiling step and at least one second motor reducer unit operating at a second speed for the speedy displacement of the annular plate in the step of expulsion of the formed coil.

11. Assembly as in claim 7, in which the chains are distributed symmetrically in cooperation with the circumference of the annular plate.

12. Assembly as in claim 7, in which the chains cooperate with a transmission wheel associated with balancing systems.

13. Assembly as in claim 1, in which the feeding element has a first limit position for cooperation with an outer sidewall of the annular channel and a second limit position for cooperation with an inner sidewall of the annular channel.

* * * * *